US010215420B2

(12) United States Patent
Froelicher et al.

(10) Patent No.: US 10,215,420 B2
(45) Date of Patent: Feb. 26, 2019

(54) OVEN APPLIANCE

(71) Applicant: Haier US Appliance Solutions, Inc., Wilmington, DE (US)

(72) Inventors: Stephen Bernard Froelicher, Louisville, KY (US); Christopher James Adelmann, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 246 days.

(21) Appl. No.: 15/218,122

(22) Filed: Jul. 25, 2016

(65) Prior Publication Data

US 2018/0020680 A1 Jan. 25, 2018

(51) Int. Cl.

| | |
|---|---|
| ***F24C 15/00*** | (2006.01) |
| ***F24C 15/32*** | (2006.01) |
| ***F24C 15/02*** | (2006.01) |
| ***F24C 15/20*** | (2006.01) |

(52) U.S. Cl.

CPC ..... *F24C 15/006* (2013.01); *F24C 15/025* (2013.01); *F24C 15/2007* (2013.01); *F24C 15/32* (2013.01)

(58) Field of Classification Search

CPC ..... A21B 3/04; F24C 15/006; F24C 15/025; F24C 15/2007; F24C 15/32

See application file for complete search history.

(56) References Cited

U.S. PATENT DOCUMENTS

| | | | | |
|---|---|---|---|---|
| 4,039,292 | A * | 8/1977 | Morini | B01D 53/72 126/19 R |
| 4,616,562 | A | 10/1986 | Kuechler | |
| 7,699,051 | B2 * | 4/2010 | Gagas | F24C 15/2028 126/299 D |
| 7,739,948 | B2 | 6/2010 | Backus et al. | |
| 9,016,191 | B2 * | 4/2015 | Krolick | A47J 37/01 99/447 |
| 2009/0008379 | A1 | 1/2009 | Ingemanson | |
| 2014/0216434 | A1 * | 8/2014 | Moreth, III | F24C 15/322 126/21 A |
| 2016/0025352 | A1 * | 1/2016 | Lee | F24C 15/006 219/391 |
| 2016/0033142 | A1 * | 2/2016 | Oh | F24C 15/006 126/198 |

FOREIGN PATENT DOCUMENTS

| | | |
|---|---|---|
| JP | 4931186 B2 | 5/2012 |

* cited by examiner

*Primary Examiner* — Gregory L Huson
*Assistant Examiner* — Brandon Nelan
(74) *Attorney, Agent, or Firm* — Dority & Manning, P.A.

(57) ABSTRACT

An air distribution assembly for an oven appliance is provided. The air distribution assembly includes an air distribution manifold mounted to a housing of the oven appliance at an opening of the housing. An air handler draws air into the air distribution manifold through a manifold inlet, circulates the air throughout the air distribution manifold, and discharges the air through a manifold outlet. A variety of cooling air flow paths may be defined within the air distribution manifold and/or oven appliance, thereby providing optimal cooling with a simplified construction.

20 Claims, 12 Drawing Sheets

OVEN APPLIANCE

FIELD OF THE INVENTION

The present subject matter relates generally to oven appliances, such as pizza oven appliances, and cooling systems for the same.

BACKGROUND OF THE INVENTION

Pizza ovens generally include a housing that defines a cooking chamber for receiving a pizza for cooking. Heating elements, such as gas burners or burning wood, heat the cooking chamber to a suitable temperature. Certain pizza ovens operate at high temperatures. For example, the operating temperatures of such pizza ovens can be higher than five hundred degrees Fahrenheit.

Cooling pizza ovens operating at high temperatures poses challenges. To provide suitable cooling, pizza ovens generally include a venting duct. The venting duct extends from the pizza oven to an exterior of a building housing the pizza oven such that the venting duct directs heat, cooking fumes and smoke from the pizza oven to the exterior of the building housing the pizza oven. Such venting ducts are effective for limiting heat, cooking fumes, and smoke accumulation within the building housing the pizza oven. However, venting ducts can be expensive to install and/or maintain. Thus, pizza ovens are generally uneconomical for residential installation.

Accordingly, a pizza oven with features for cooling the pizza oven would be useful. In particular, a pizza oven with features for cooling the pizza oven that does not require expensive ducting to an exterior of a building housing the pizza oven would be useful.

BRIEF DESCRIPTION OF THE INVENTION

The present subject matter provides an air distribution assembly for an oven appliance. The air distribution assembly includes an air distribution manifold mounted to a housing of the oven appliance at an opening of the housing. An air handler draws air into the air distribution manifold through a manifold inlet, circulates the air throughout the air distribution manifold, and discharges the air through a manifold outlet. A variety of cooling air flow paths may be defined within the air distribution manifold and/or oven appliance, thereby providing optimal cooling with a simplified construction. Additional aspects and advantages of the invention will be set forth in part in the following description, or may be apparent from the description, or may be learned through practice of the invention.

In a first exemplary embodiment, an oven appliance is provided. The oven appliance includes a housing defining a cooking chamber and an opening for accessing the cooking chamber. An upper heating element array is positioned within the housing at a top portion of the cooking chamber. A baking stone is positioned within the housing at a bottom portion of the cooking chamber and a lower heating element array positioned within the housing below the baking stone adjacent the bottom portion of the cooking chamber. An air distribution manifold is mounted to the housing at the opening of the housing, the air distribution manifold defining a manifold inlet and a manifold outlet, the air distribution manifold including a top manifold, a bottom manifold, and two side manifolds that are in fluid communication with each other and extend about the opening of the housing. An air handler is positioned within the air distribution manifold, the air handler being configured for drawing air in the manifold inlet and urging air out the manifold outlet.

In a second exemplary embodiment, an air distribution assembly for an oven appliance is provided. The oven appliance includes a housing defining a cooking chamber and an opening for accessing the cooking chamber. The air distribution assembly includes an air distribution manifold mounted to the housing at the opening of the housing, the air distribution manifold defining a manifold inlet, a manifold outlet, and a manifold opening that corresponds with the opening of the housing. An air handler is positioned within the air distribution manifold, the air handler being configured for drawing air in the manifold inlet and urging air out the manifold outlet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
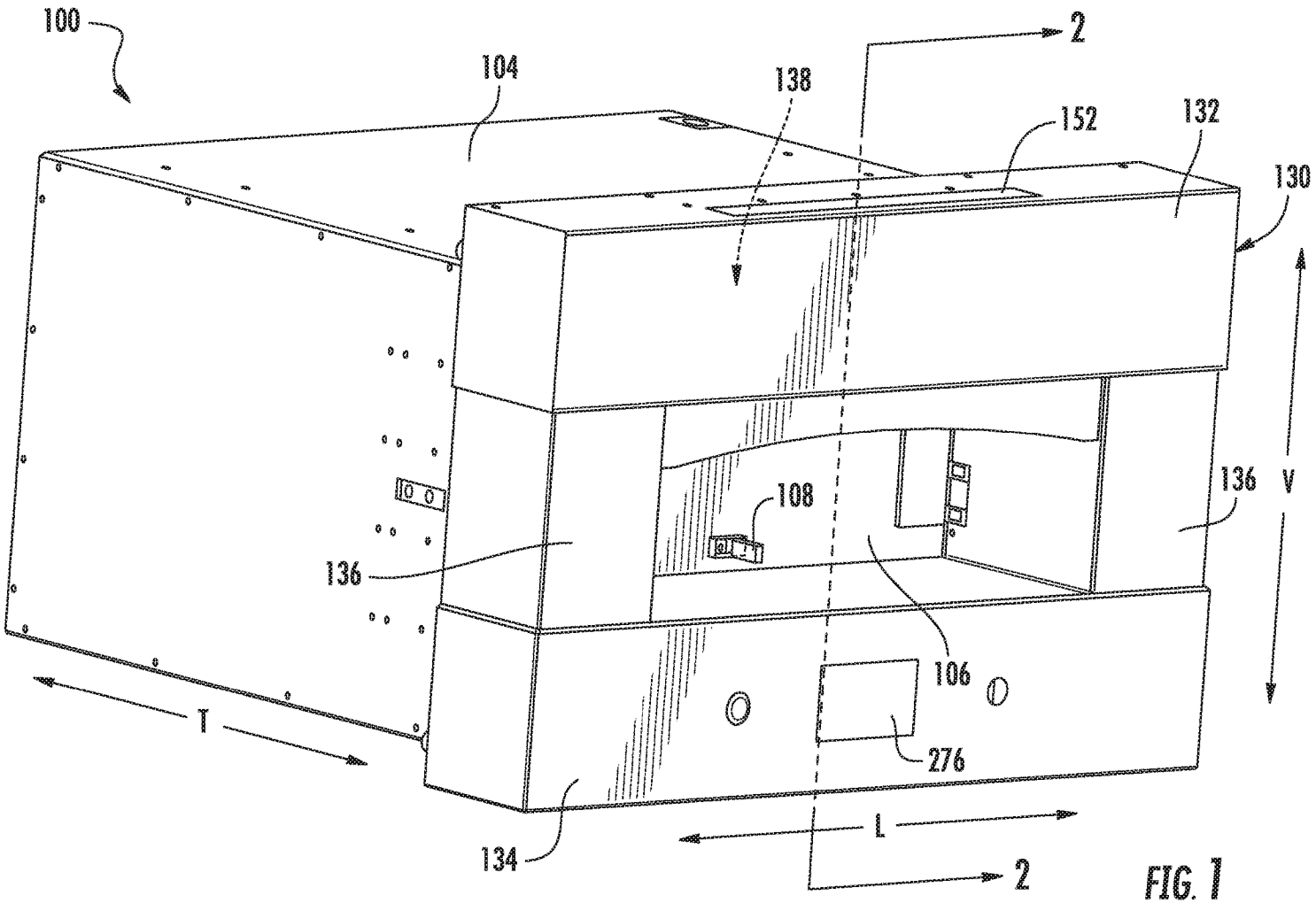
FIG. 1 provides a perspective view of an oven appliance positioned within a cabinet according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
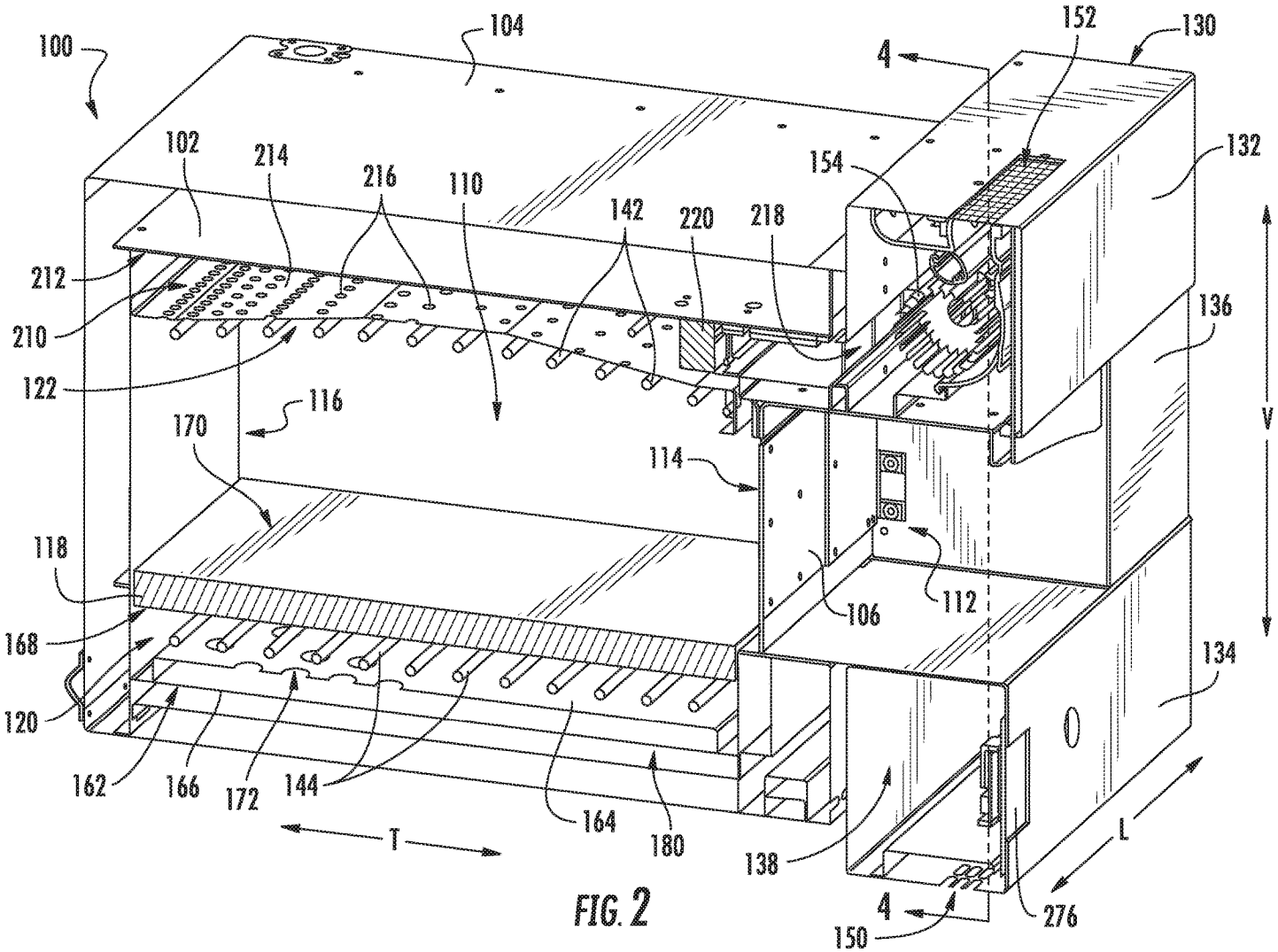
FIG. 2 provides a perspective section view of the exemplary oven appliance of FIG. 1, taken along Line 2-2 of FIG. 1.

FIG. 1 provides a perspective view of an oven appliance 100 according to an exemplary embodiment of the present subject matter. FIG. 2 provides a perspective, section view of the exemplary oven appliance of FIG. 1, taken along Line 2-2 of FIG. 1. As may be seen in FIGS. 1 and 2, oven appliance 100 includes a housing 102 and may be positioned within a cabinet 104. Housing 102 defines a cooking chamber 110 which is configured for receiving food items for cooking therein. In particular, housing 102 also defines an opening 112 for accessing cooking chamber 110. Opening 112 is positioned at a front portion 114 of housing 102, and a user of oven appliance 100 may place food items into and remove food items from cooking chamber 110 via opening 112. As may be seen in FIG. 1, cooking chamber 110 is open such that cooking chamber 110 is contiguous with or exposed to ambient atmosphere about oven appliance 100, e.g., about housing 102, via opening 112.

As illustrated in FIGS. 1 and 2, oven appliance 100 may include a fire door 106 that is pivotally connected to housing 102. During normal cooking operation, fire door 106 is configured to remain in the open position (see, e.g., FIG. 3), such that air within cooking chamber 110 is in direct flow communication with the ambient environment. In this regard, a pin (not shown) is configured to engage a latch 108 (FIG. 1) on fire door 106. The pin holds fire door 106 in the open positioned until a dangerous condition is sensed, at which time the pin is retracted, releasing fire door 106 and allowing it to drop to a closed position under the force of gravity. For example, fire door 106 may be configured to close if the temperature within cooking chamber 110 reaches a predetermined threshold, if harmful gases are detected, or if another dangerous condition is sensed.

A baking stone 118 is positioned within housing 102 at a bottom portion 120 of cooking chamber 110. Thus, baking stone 118 may form at least a portion of a floor of cooking chamber 110. Food items, such as pizza, may be placed directly on baking stone 118 during operation of oven appliance 100, as will be understood by those skilled in the art. Baking stone 118 may be constructed of or with any suitable material. For example, baking stone 118 may be constructed of or with a ceramic, clay or stone. In particular, baking stone 118 may be constructed of or with a porous ceramic or porous stone.

Oven appliance 100 also includes a casing or air distribution manifold 130. Air distribution manifold 130 is mounted to housing 102 at opening 112 of housing 102. In particular, as shown in FIG. 1, air distribution manifold 130 may include a top manifold 132, a bottom manifold 134, and two or more side manifolds 136. According to the illustrated embodiment, top manifold 132, bottom manifold 134, and side manifolds 136 are in fluid communication with each other, thereby forming a single, contiguous air plenum 138.

Air distribution manifold 130 may extend about opening 112 of housing 102. Thus, a user may reach through opening 112 into cooking chamber 110 at air distribution manifold 130. Air distribution manifold 130 may have any suitable shape and/or appearance. For example, air distribution manifold 130 may be rectangular with flat elements as shown in FIG. 1. In alternative exemplary embodiments, air distribution manifold 130 may include column shaped elements, rounded elements, etc. Air distribution manifold 130 may be formed of or with any suitable material. For example, an outer surface of air distribution manifold 130 may be constructed of or with stainless steel, painted steel, enameled steel, copper or combinations thereof.

Figure 3:
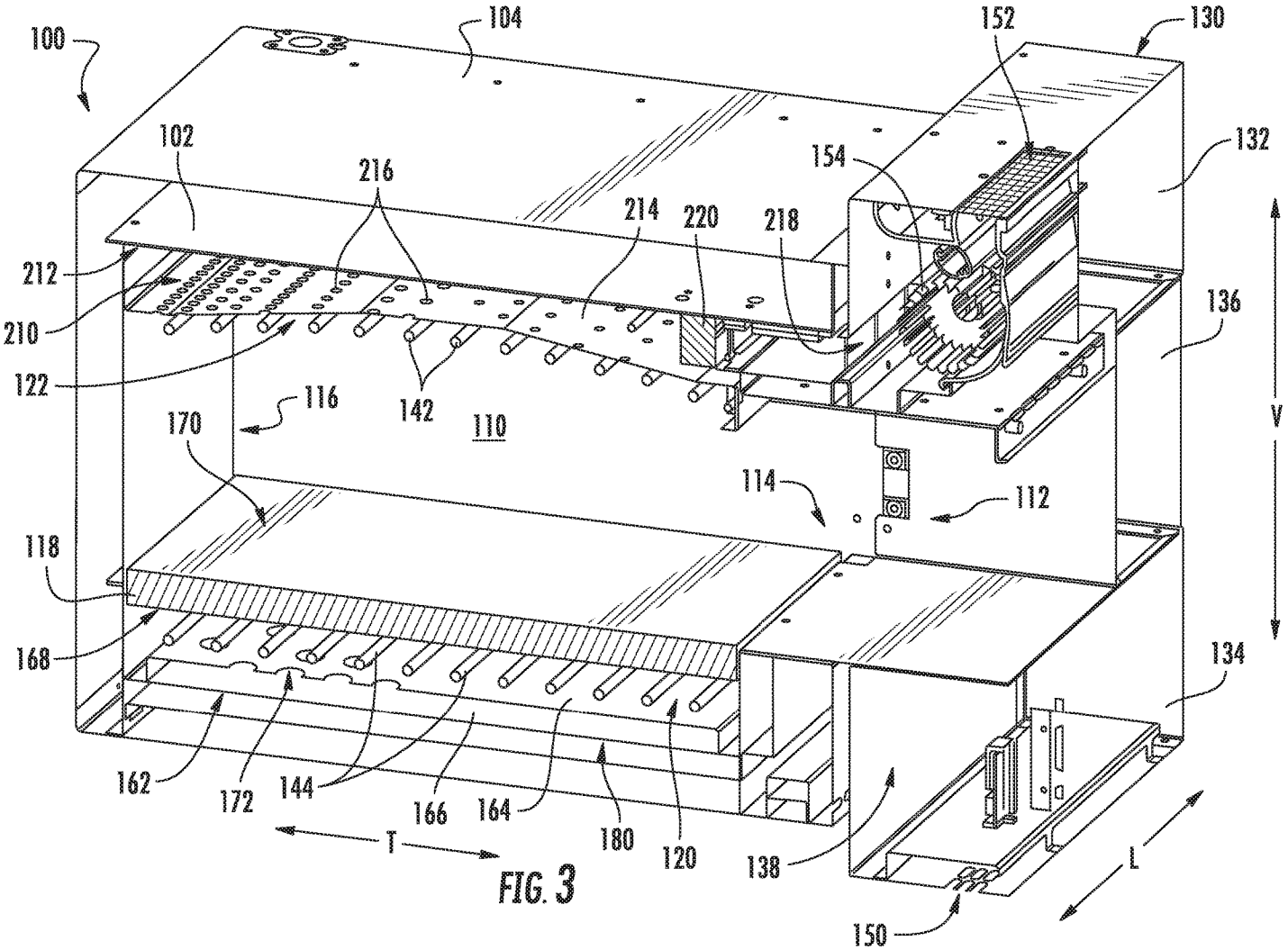
FIG. 3 provides a perspective section view of the exemplary oven appliance of FIG. 1, taken along Line 3-3 of FIG. 2.

Air distribution manifold 130 may be removably mounted to housing 102 using any suitable method or mechanism. As illustrated in FIGS. 2 and 3, air distribution manifold 130 has a flange that extends towards housing 102, e.g., along the transverse direction T, proximate or at opening 112. A plurality of fasteners extend through flange into housing 102 in order to mount air distribution manifold 130 to housing 102. However, one skilled in the art will appreciate that air distribution manifold 130 may be mounted to housing 102 using any suitable mechanical fastener, such as screws, bolts, rivets, etc. Similarly, glue, bonding, welding, snap-fit mechanisms, interference-fit mechanisms, or any suitable combination thereof be used to join air distribution manifold 130 and housing 102.

FIGS. 2 through 12 provide various schematic and section views of oven appliance 100 positioned within cabinet 104. As illustrated in the figures, oven appliance 100 defines a vertical direction V, a lateral direction L and a transverse direction T. The vertical direction V, the lateral direction L, and the transverse direction T are mutually perpendicular and form an orthogonal direction system. Various features of oven appliance 100 are discussed in greater detail below in the context of FIGS. 2 through 12. However, oven appliance 100 is used herein only for the purpose of describing one exemplary embodiment of the present subject matter. One skilled in the art would appreciate that aspects of the present subject matter may be used in other oven appliances without departing from the scope of the present disclosure.

Oven appliance 100 includes heating element arrays for heating cooking chamber 110 and food items therein. In particular, an upper heating element array 142 is positioned within housing 102 at a top portion 122 of cooking chamber 110. In addition, a lower heating element array 144 is positioned within housing 102 below baking stone 118 adjacent bottom portion 120 of cooking chamber 110. Thus, lower heating element array 144 may not be directly exposed to cooking chamber 110, and baking stone 118 may be positioned between cooking chamber 110 and lower heating element array 144, e.g., along the vertical direction V. According to the illustrated embodiment, upper and lower heating element arrays 142, 144 are electrical heating element arrays. For example, upper and lower heating element arrays 142, 144 are constructed of or with electrical resistance heating elements, such as calrods. However, according to alternative embodiments, oven appliance 100 may include gas burners, may be a wood burning oven, or may be heated in any other suitable manner.

As discussed above, air distribution manifold 130 is mounted to housing 102 and defines air plenum 138. Thus, air distribution manifold 130 may be hollow and defines at least one manifold inlet 150 and at least one manifold outlet 152, as described in detail below. Manifold inlets and outlets 150, 152 are contiguous with ambient air about housing 102. Thus, ambient air about housing 102 may flow into air plenum 138 via manifold inlets 150. In particular, oven appliance 100 includes an air handler 154 for drawing air in the manifold inlet 150 and urging air out the manifold outlet 152, as described below. According to the illustrated embodiment, air handler 154 is a tangential fan positioned within top manifold 132 of air distribution manifold 130. However, according to alternative embodiments, any suitable type or number of air handlers may be used, and the air handlers may be positioned in any location suitable for circulating air within air distribution manifold 130.

By operating air handler 154, air plenum 138 may be maintained at a negative pressure relative to the ambient air surrounding housing 102 and the heated air within cooking chamber 110. In this manner, air handler 154 may draw in ambient air from the environment surrounding oven appliance 100, heated air from within cooking chamber 110, and cooling air from cooling air passages positioned within housing 102, as described below. The air is then discharged from air distribution manifold 130 via manifold outlet 152 at a safe temperature and in a manner that minimizes the risk of burning a user of oven appliance 100. The airflows generated by air handler 154 may be drawn through and across various parts of oven appliance 100, e.g., to assist with cooling oven appliance 100, to assist with regulating a temperature of baking stone 118, and/or to assist with drawing and treating cooking fumes from cooking chamber 110 of housing 102, as discussed in greater detail below.

Figure 4:
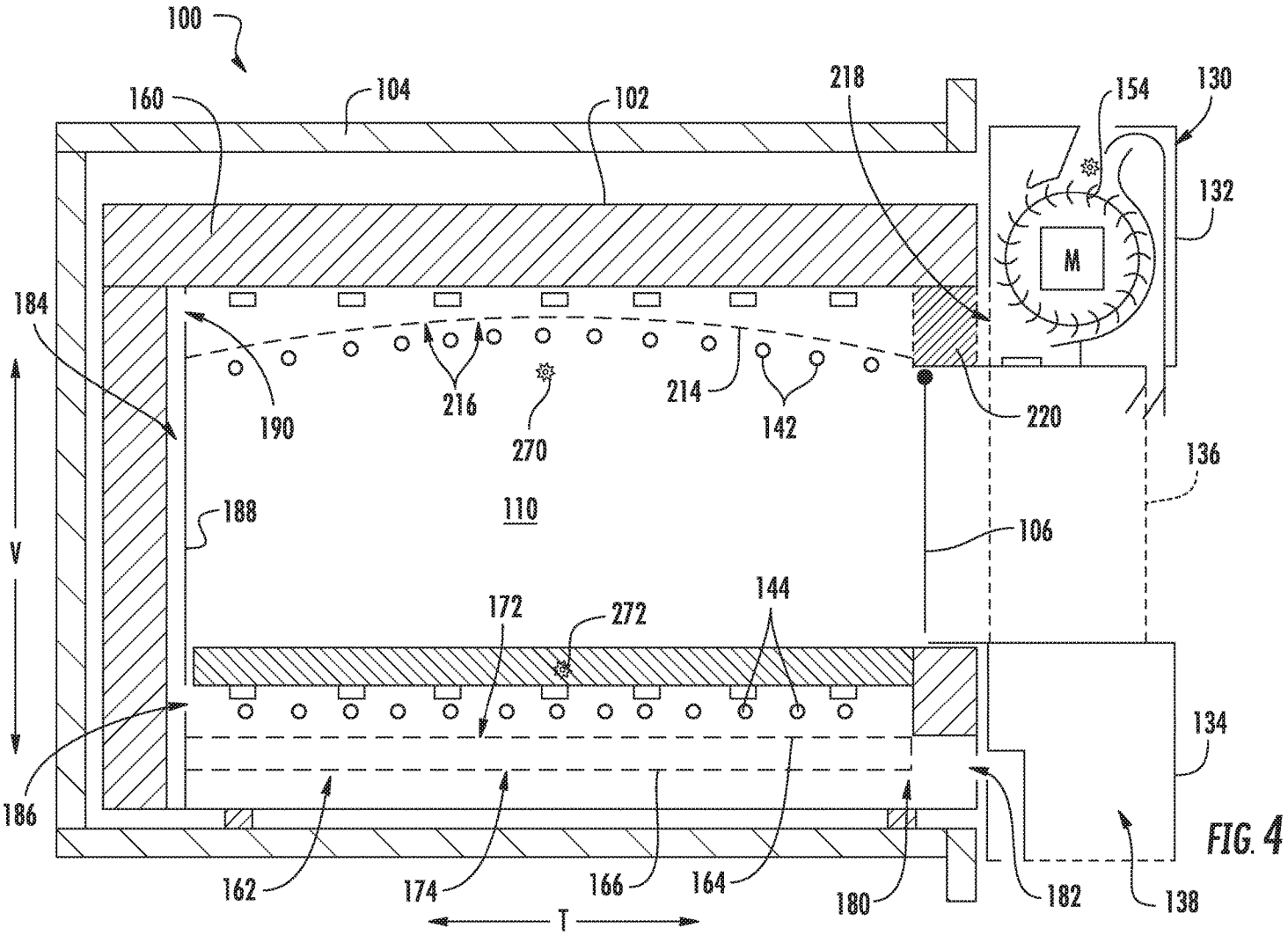
FIG. 4 provides a schematic side view of the exemplary oven appliance of FIG. 1.
Figure 5:
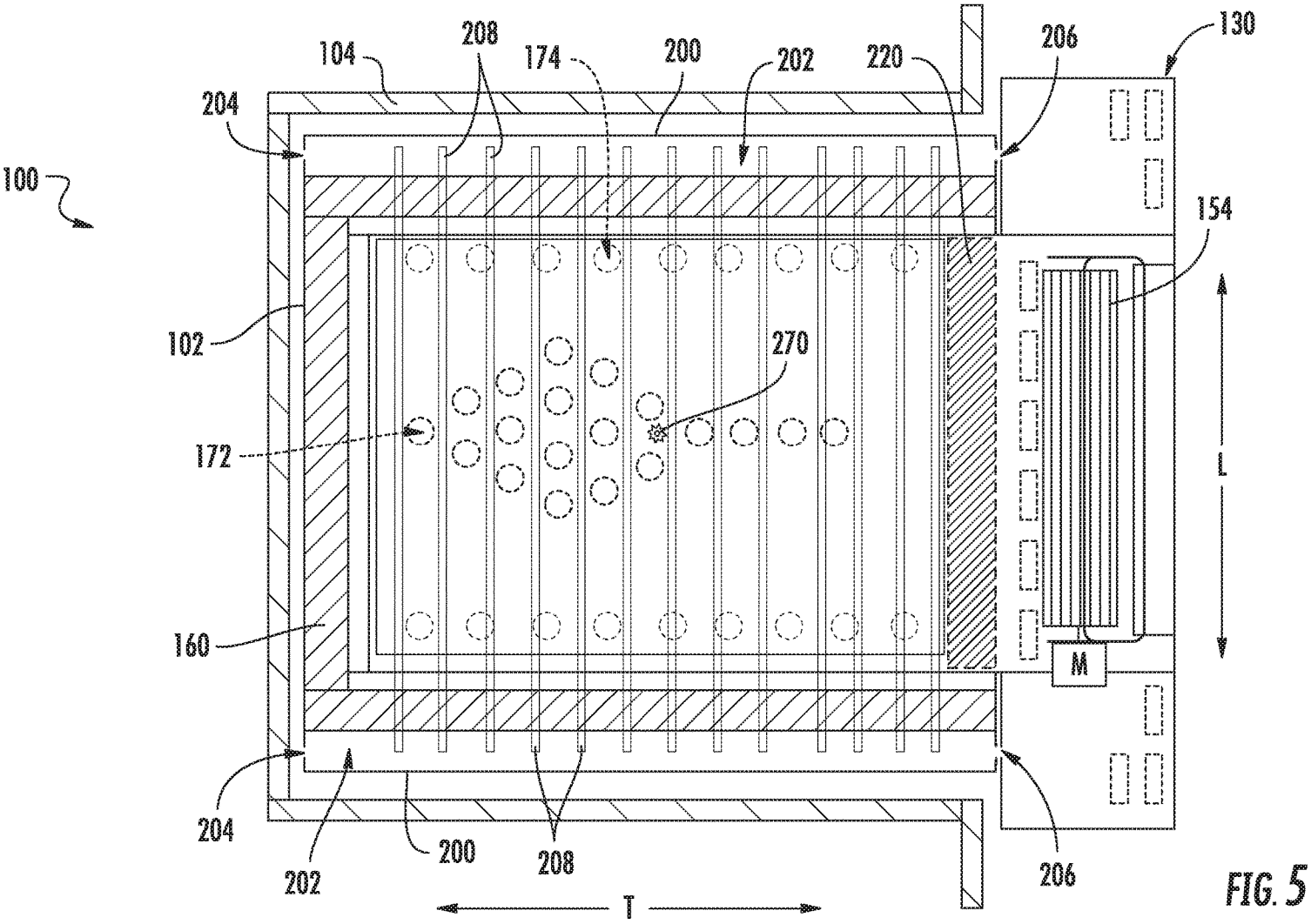
FIG. 5 provides a schematic top view of the exemplary oven appliance of FIG. 1.
Figure 6:
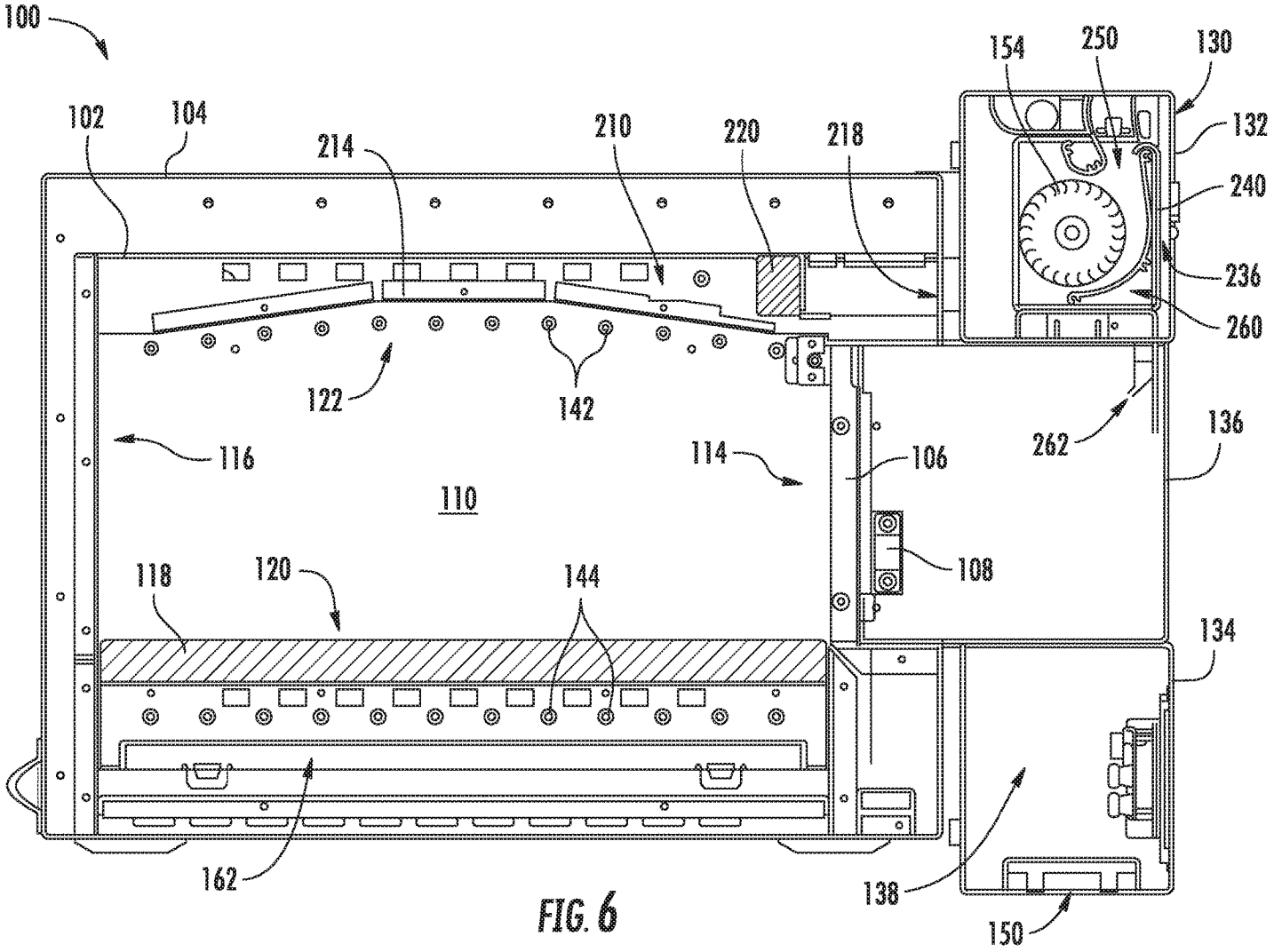
FIG. 6 provides a side section view of the exemplary oven appliance of FIG. 1, taken along Line 2-2 of FIG. 1.

Oven appliance 100 includes various features for limiting or reducing heat transfer from cooking chamber 110 to cabinet 104. Referring now to FIGS. 4 and 5, several of these features will be described. FIGS. 4 and 5 provide a schematic side view and a schematic top view, respectively, of an oven appliance according to an exemplary embodiment of the present subject matter, e.g., oven appliance 100. As shown, oven appliance 100 includes insulation 160 within housing 102, e.g., such that housing 102 is an insulated housing. Insulation 160 is positioned between cooking chamber 110 and cabinet 104. Oven appliance 100 also includes a baffle 162 within housing 102. Baffle 162 is positioned within housing 102 below lower heating element array 144. Thus, baffle 162 limits or reduces heat transfer between lower heating element array 144 and a floor of cabinet 104.

As may be seen in FIG. 2, baffle 162 includes an upper plate 164 and a lower plate 166. Upper plate 164 and lower plate 166 are spaced apart from each other, e.g., along the vertical direction V. Thus, a thermal break may be formed between upper plate 164 and lower plate 166, e.g., along the vertical direction V. Baffle 162 may include features for directing a flow of air through baffle 162 to lower heating element array 144 and/or a bottom surface 168 of baking stone 118.

For example, as best illustrated in FIGS. 4 and 5, upper plate 164 defines a plurality of holes 172, and lower plate 166 also defines a plurality of holes 174. Holes 172 of upper plate 164 are offset from holes 174 of lower plate 166, e.g., along the lateral direction L and/or transverse direction T. Thus, holes 172 of upper plate 164 may be misaligned with holes 174 of lower plate 166, e.g., along the vertical direction V. Such distribution of holes 172 of upper plate 164 relative to holes 174 of lower plate 166 may assist with limiting radiant heat transfer from lower heating element array 144 through baffle 162.

Holes 174 of lower plate 166 are contiguous with a regulating air duct 180 of housing 102. In particular, air from regulating air duct 180 may flow into and enter baffle 162 through holes 174 of lower plate 166. The air may then flow between upper and lower plates 164, 166 to holes 172 of upper plate 164, and the air may exit baffle 162 at holes 172 of upper plate 164. After exiting holes 172 of upper plate 164, the air may flow along bottom surface 168 of baking stone 118 in order to assist with regulating a temperature of baking stone 118. In particular, the air exiting holes 172 of upper plate 164 may assist with cooling baking stone 118. Inlet 182 of regulating air duct 180 (or any other orifice of regulating air duct 180) may be metered to regulate the flow of air through regulating air duct 180 to baking stone 118.

Holes 172 of upper plate 164 and holes 174 of lower plate 166 may be distributed in any suitable manner relative to one another. For example, as best shown in FIG. 5, holes 172 of upper plate 164 may be positioned proximate a rear, central portion of upper plate 164, e.g., below a central portion of baking stone 118. Conversely, holes 174 of lower plate 166 may be positioned proximate edge portions of lower plate 166. According to some exemplary embodiments, holes 172 of upper plate 164 may be more densely distributed toward a rear half of upper plate 164, such that they are positioned below a rear half of baking stone 118. One skilled in the art will appreciate that holes 172, 174 may be any suitable size, shape, number, and distribution across upper and lower plates 164, 166 in order to, e.g., maintain a uniform heat distribution at a top surface 170 of baking stone 118 while also limiting radiant heat transfer from lower heating element array 144 through baffle 162.

After cooling air flows across baking stone 118, it may be directed away from baffle 162 and baking stone 118. In particular, housing 102 may include a rear cooling channel 184. One or more rear channel inlets 186 may be positioned along a rear wall 188 proximate bottom portion 120 of cooking chamber 110, such as just below baking stone 118. Similarly, one or more rear channel exits 190 may be positioned along rear wall 188 proximate top portion 122 of cooking chamber 110. Rear channel inlets and outlets 186, 190 may be, for example, a single elongated slot or a plurality of apertures. Rear cooling channel 184 may be defined between rear wall 188 and insulation 160, and may extend along the vertical direction V between rear channel inlet 186 and rear channel outlet 190. In this manner, cooling air flows past baking stone 118, into rear channel inlet 186, through rear cooling channel 184, and through rear channel exit 190 back into top portion 122 of cooking chamber 110. As will be explained in more detail below, cooling air exiting rear channel exit 190 may be drawn through top portion 122 of cooking chamber 110 back into air distribution manifold 130.

Referring now to FIG. 5, housing 102 may further include a pair of side panels 200 that extend along the vertical direction V and may be positioned opposite each other about cooking chamber 110 of housing 102, e.g., such that side panels 200 are spaced apart from each other along the lateral direction L. Rear wall 188 is also positioned at and may assist with defining cooking chamber 110 of housing 102. Rear wall 188 is positioned adjacent rear portion 116 of housing 102 and may extend between side panels 200, e.g., along the lateral direction L.

Side panels 200 may be spaced apart from insulation 160 along the lateral direction L to define a cooling air duct 202. Therefore, cooling air ducts 202 are positioned at each lateral side of cooking chamber 110. Cooling air duct 202 may extend between an entrance 204 positioned proximate rear portion 116 of cooking chamber 110 and an exit 206 positioned proximate front portion 114 of cooking chamber 110. According to the illustrated embodiment, exit 206 of cooling air duct 202 is in fluid communication with air distribution manifold 130. More specifically, exit 206 includes a plurality of apertures that open up into side manifolds 136 of air distribution manifold 130.

During operation, air handler 154 creates a negative pressure in air distribution manifold 130, thereby drawing air from within cabinet 104 into cooling air ducts 202 via entrance 204. The cooling air flows through cooling air ducts 202 across side panels 200, e.g., from entrance 204 to exit 206 along the transverse direction T, and enters air distribution manifold via exit 206 of cooling air duct 202. In this manner, air flowing though cooling air duct 202 may assist with limiting or reducing heat transfer from housing 102 to cabinet 104 in which oven appliance 100 is positioned, as will be understood by those skilled in the art.

Figure 7:
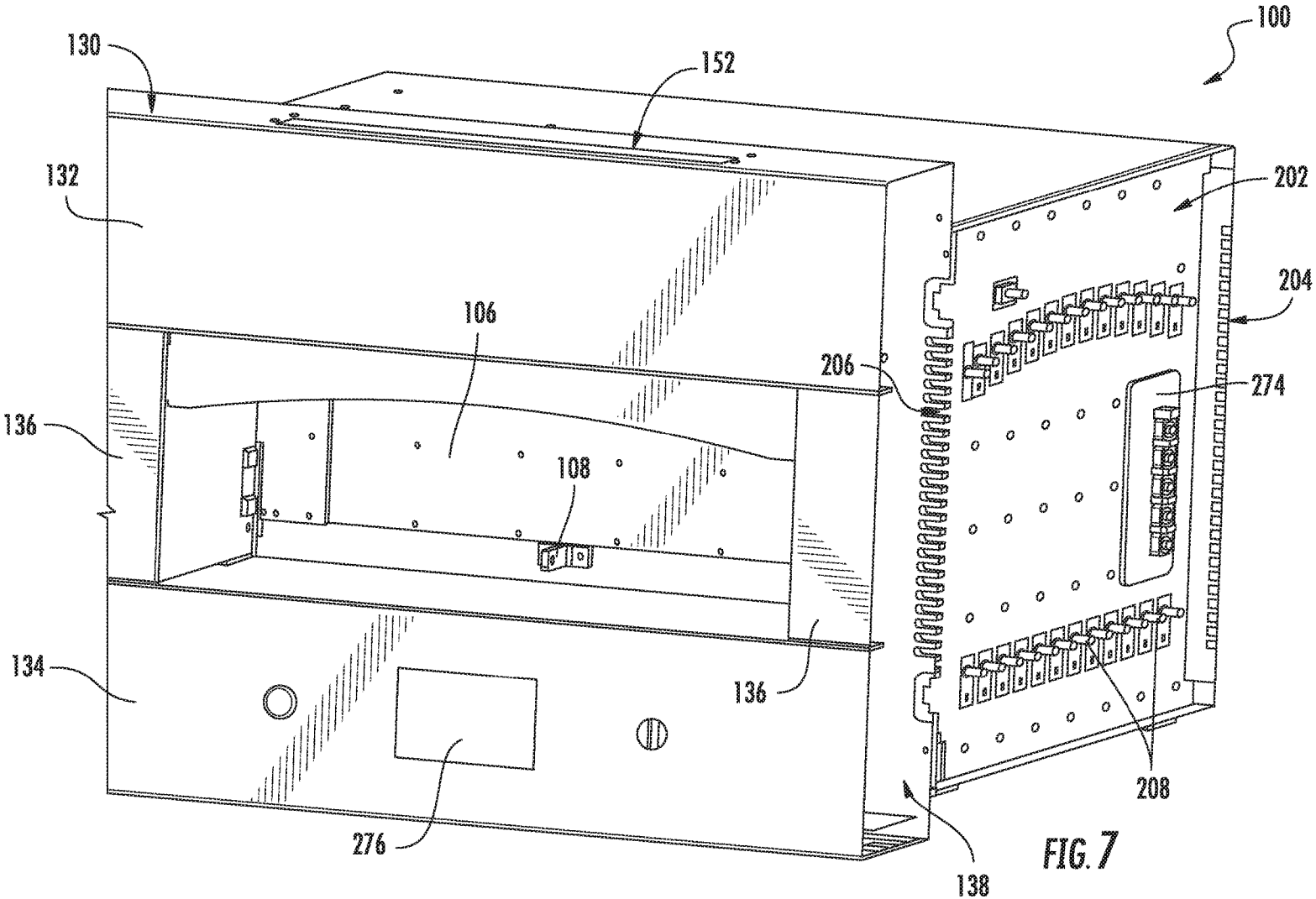
FIG. 7 provides a perspective section view of the exemplary oven appliance of FIG. 1.

In addition to limiting heat transfer to cabinet 104, cooling air duct 202 may be used to cool other components of oven appliance 100. For example, as illustrated in FIG. 7, each heating element from upper heating element array 142 and lower heating element array 144 may be joined or terminated at junctions 208. In addition, controller 274 or other components of oven appliance 100 may be positioned within cooling air ducts 202. Cool air flowing through cooling air ducts 202 may assist in maintaining a safe operating temperature for junctions 208, controller 274, and other components of oven appliance 100 which are placed within cooling air duct 202. In this manner, cooling air ducts 202 cool side panels 200 and maintain a safe operating temperature of oven appliance 1000.

Oven appliance 100 further includes features for assisting with venting cooking fumes and/or smoke into the ambient atmosphere about oven appliance 100. In particular, oven appliance 100 may include a venting channel 210. According to the illustrated embodiment, venting channel 210 is positioned within cooking chamber 110 and is defined at least in part by a top wall 212 of housing 102, side panels 200, and a perforated deflector plate 214. Deflector plate 214 may include a plurality of apertures 216 to allow heated air from within cooking chamber 110 to flow into venting channel 210. Thus, venting channel 210 may be in fluid communication with cooking chamber 110 and exit 190 of rear cooling channel 184, such that cooking fumes and/or smoke from cooking chamber 110 may enter and flow into venting channel 210.

Venting channel 210 may also be in fluid communication with air distribution manifold 130 via one or more venting channel inlets 218. During operation, air handler 154 draws air from venting channel 210 through venting channel inlet 218 into air distribution manifold 130. In this manner, air handler 154 circulates air within venting channel 210 and cooking chamber 210 through air distribution manifold 130, thereby venting cooking fumes and/or smoke. Thus, oven appliance 100 need not include or be coupled to venting ducts that direct cooking fumes and/or smoke to an exterior atmosphere outside of the building housing oven appliance 100.

Oven appliance 100 also includes features for treating the cooking fumes and/or smoke within venting channel 210. For example, venting channel 210 may further includes a smoke reduction catalyst 220 positioned within venting channel 210, e.g., at venting channel inlet 218 of venting channel 210. Smoke reduction catalyst 220 is configured for reacting with cooking fumes and/or smoke within venting channel 210 in order to reduce emission of undesirable material from venting channel 210. Smoke reduction catalyst 220 may be any suitable smoke reduction catalyst. For example, smoke reduction catalyst 220 may include ceramic plates coated with a noble (non-reactive) metal, such as palladium. The ceramic plates of smoke reduction catalyst 220 may form a honeycomb or other suitable high surface area pattern. Insulation 160 is disposed within housing 102 opposite smoke reduction catalyst 220. Insulation 160 may assist with maintaining smoke reduction catalyst 220 at a suitable temperature.

Figure 9:
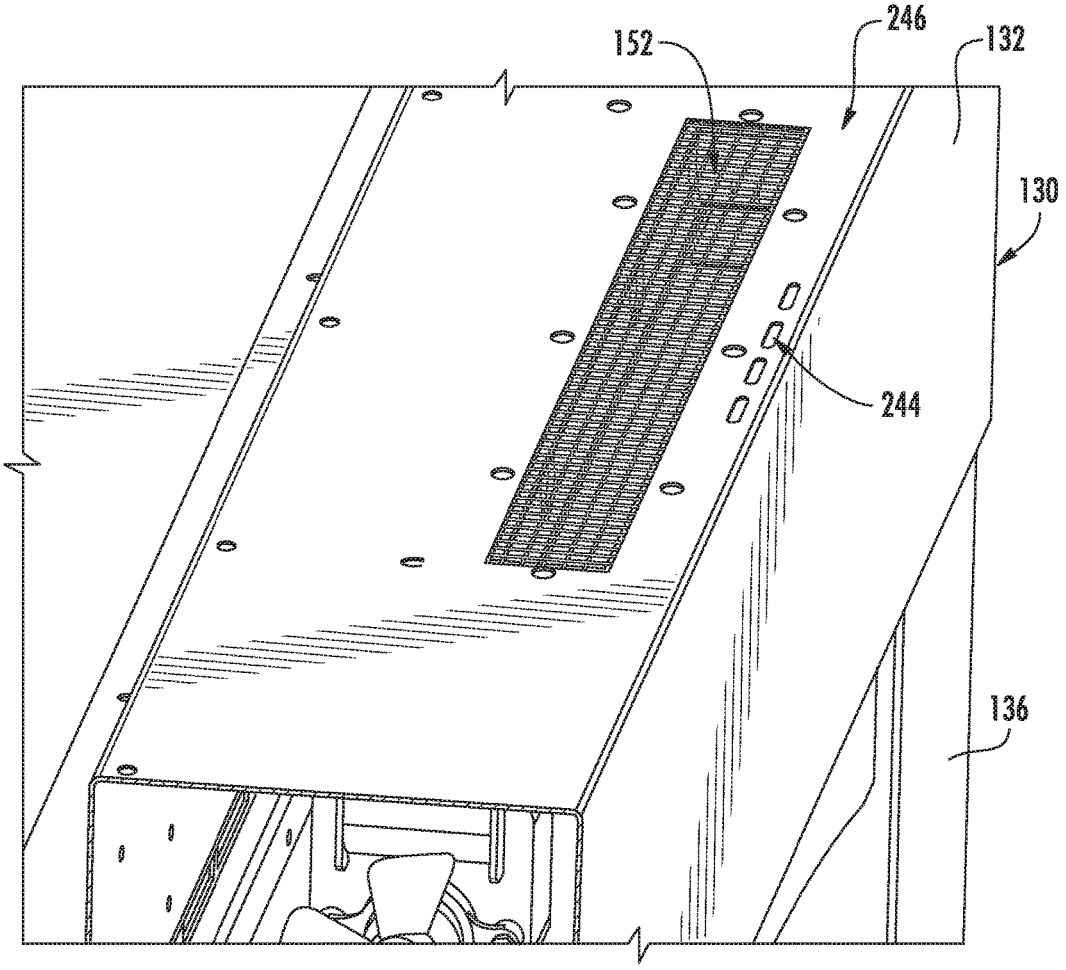
FIG. 9 provides a top, perspective view of the exemplary oven appliance of FIG. 1.
Figure 10:
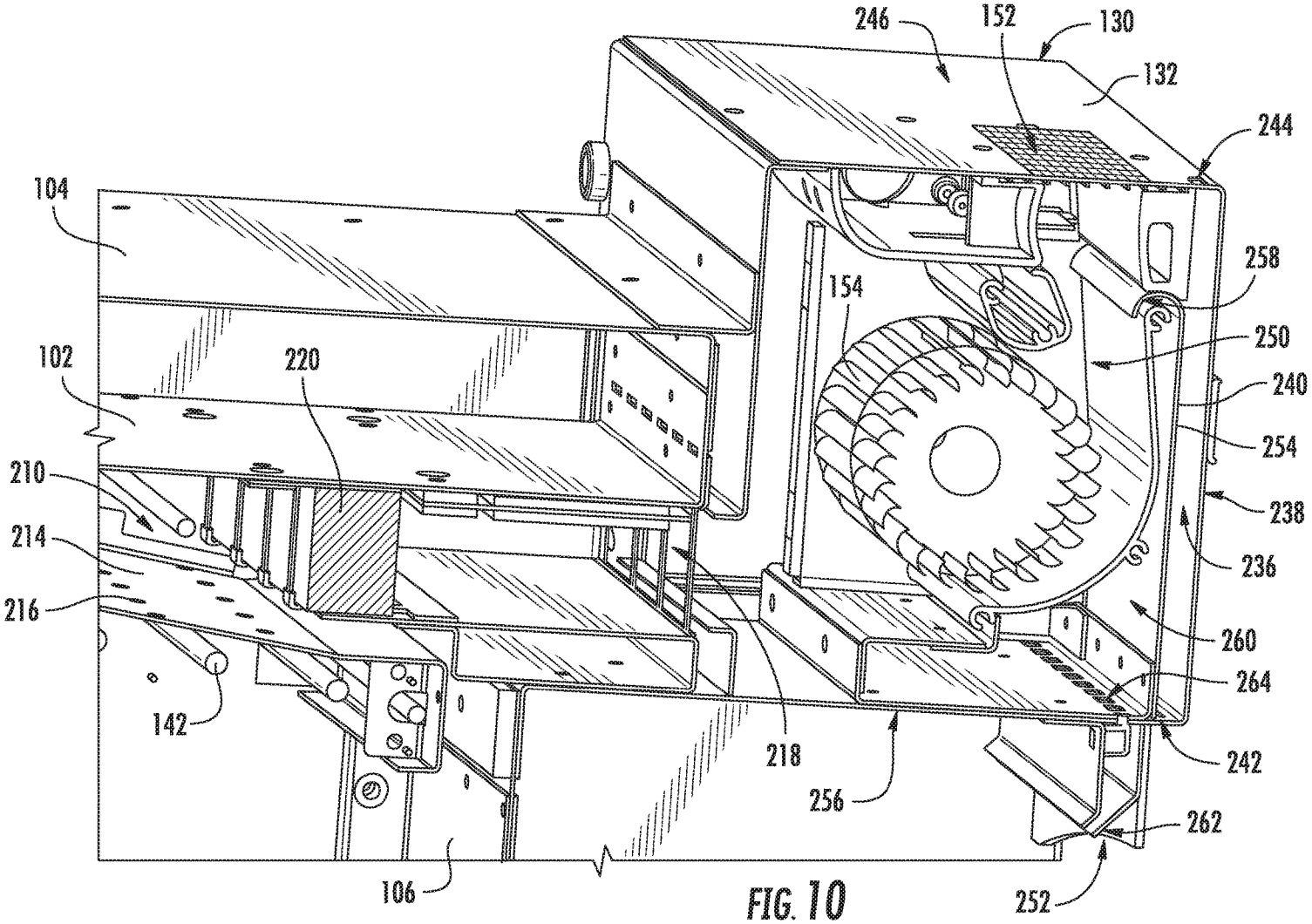
FIG. 10 provides a perspective, section view of a top manifold of an air distribution manifold of the exemplary oven appliance of FIG. 1.
Figure 11:
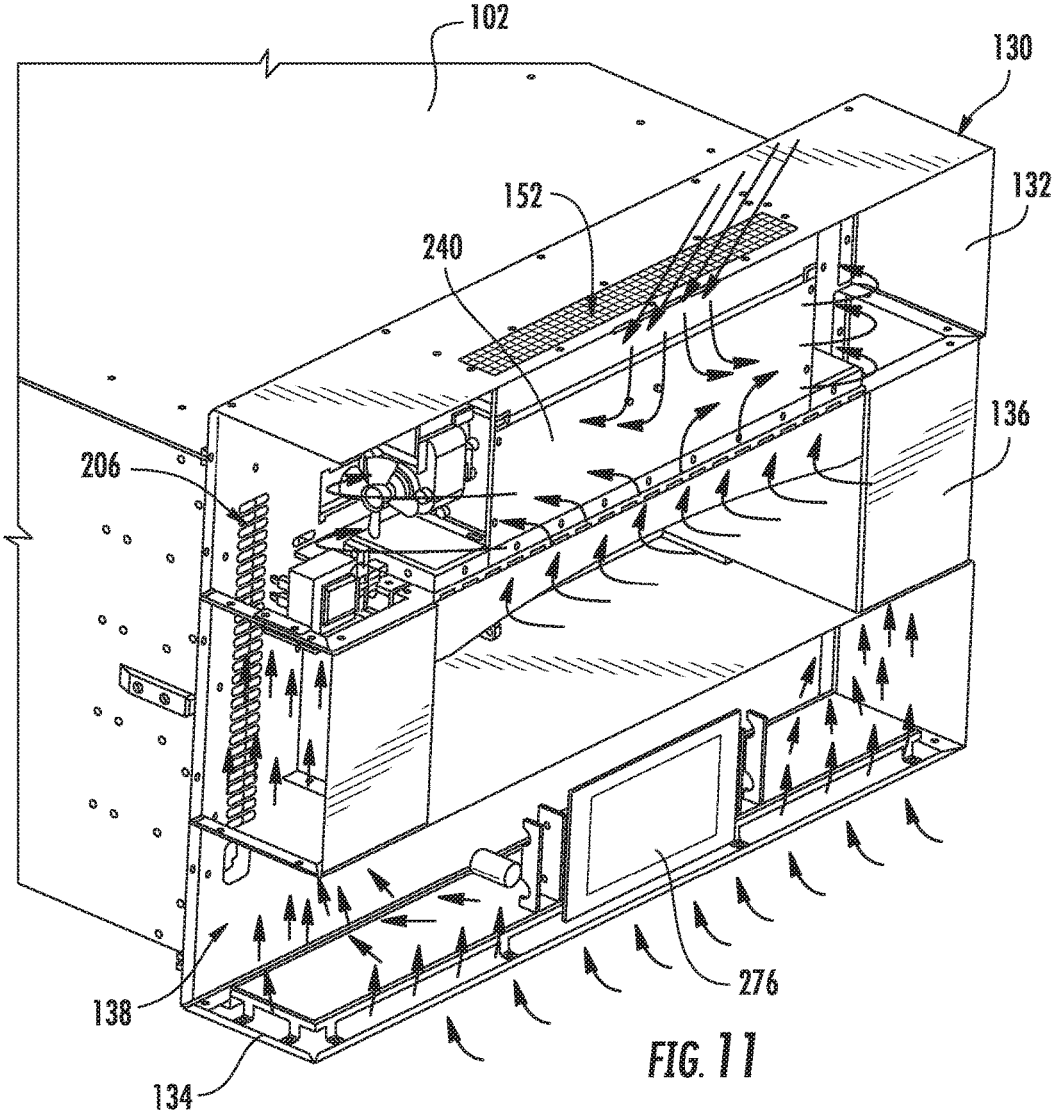
FIG. 11 provides a perspective, section view of the exemplary oven appliance of FIG. 1, with arrows illustrating various cooling air flow paths according to an exemplary embodiment of the present subject matter.
Figure 12:
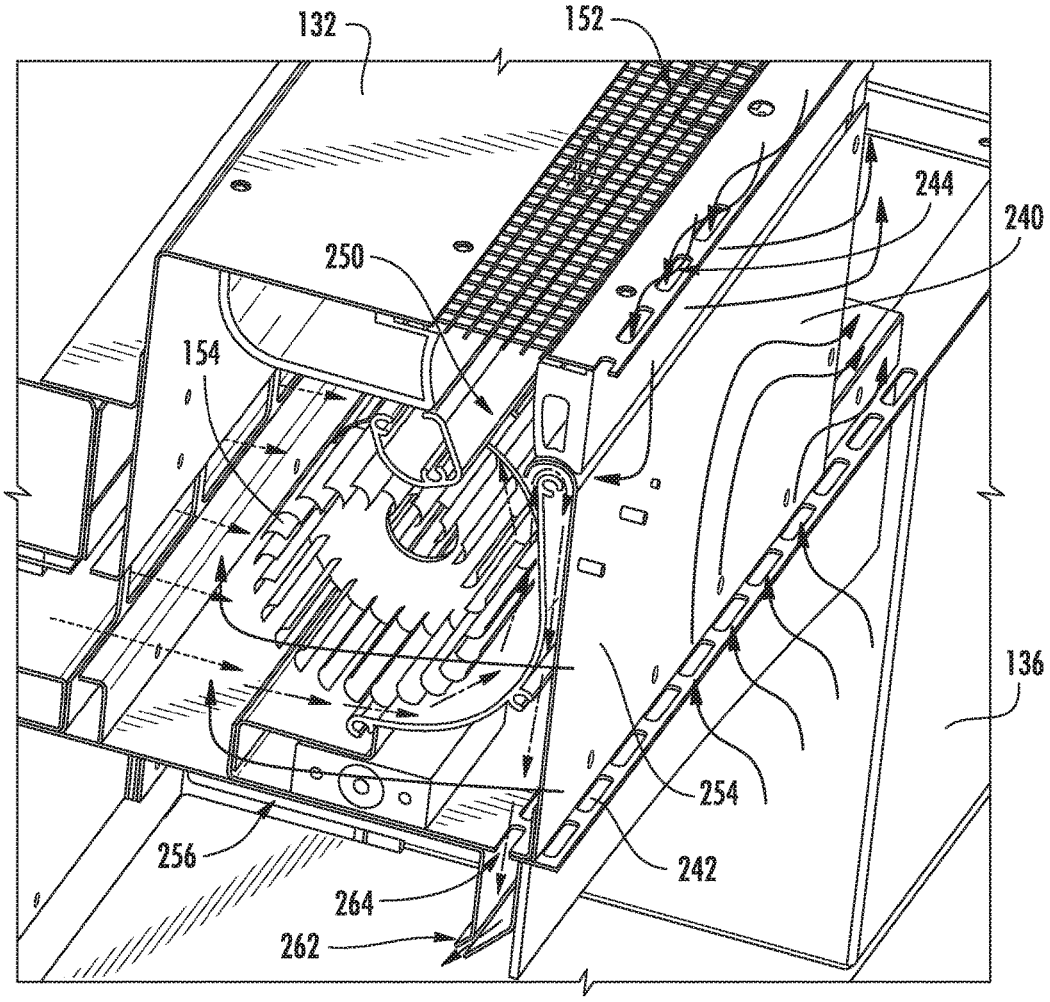
FIG. 12 provides a perspective, section view of the top manifold of the exemplary air distribution manifold of FIG. 10, with arrows illustrating various cooling air flow paths according to an exemplary embodiment of the present subject matter.

Referring now to FIGS. 7 through 12, the operation of air handler 154 and the air flow paths it generates will be described in detail. The unlabeled arrows in FIGS. 11 and 12 illustrate some exemplary flow paths of cooling air and/or exhaust air generated by air handler 154. One skilled in the art will appreciate that the flow paths illustrated provide an exemplary configuration and method for cooling air distribution manifold 130 and oven appliance 100, but that the configuration described is not intended to limit the scope of the present subject matter.

Figure 8:
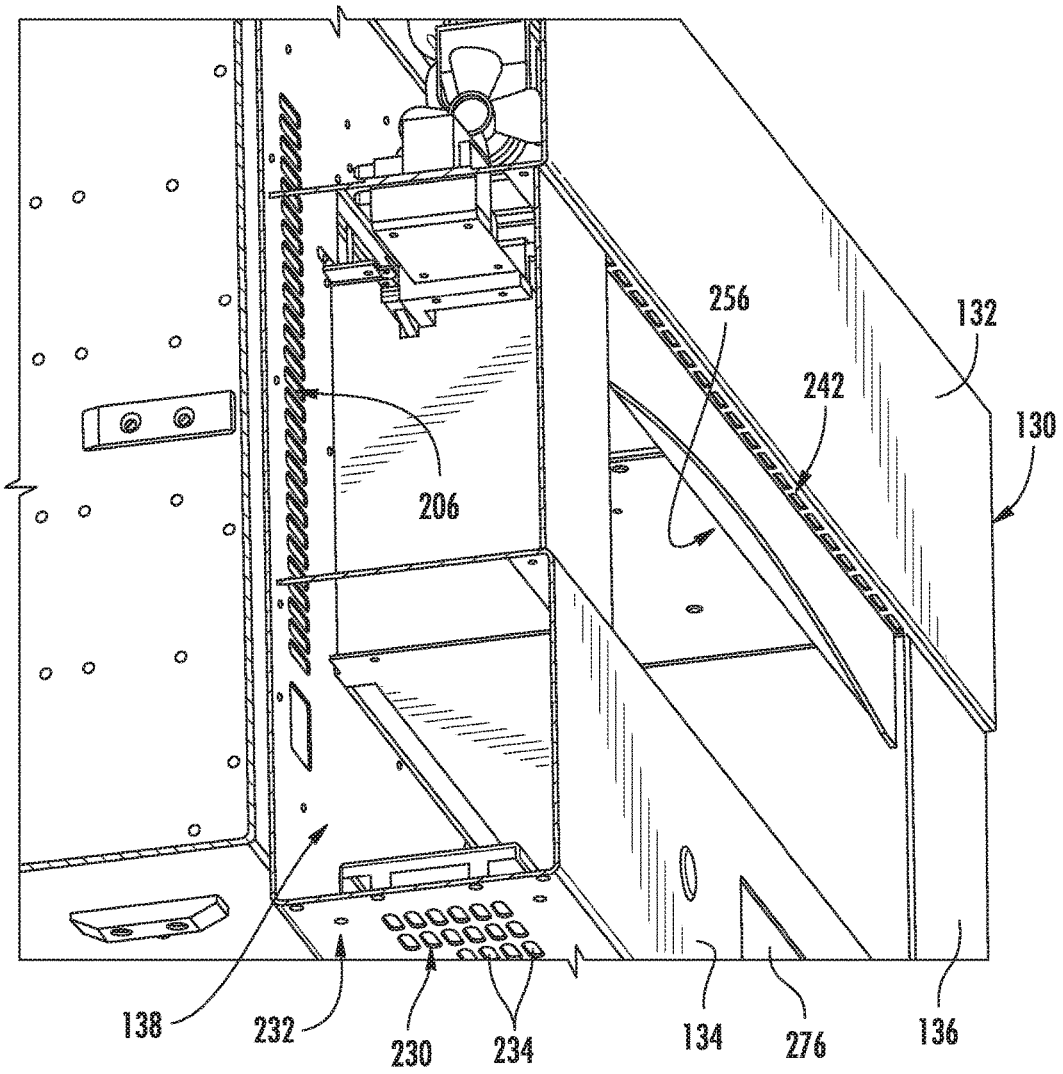
FIG. 8 provides a bottom, perspective section view of the exemplary oven appliance of FIG. 1.

Referring now generally to FIGS. 8 and 9, the positioning and configuration of various manifold inlets 150 and manifold outlets 152 according to an exemplary embodiment will be described. As shown, a first manifold inlet 230 may be positioned at a bottom surface 232 of bottom manifold 134. First manifold inlet 230 may include a plurality of slots or apertures 234.

As best illustrated in FIGS. 10 through 12, a passageway 236 may be defined within top manifold 132 of air distribution assembly 130 to assist in reducing the temperature of air distribution manifold 130 proximate the manifold outlet 152 and air handler 154. More specifically, passageway 236 may be defined between a front surface 238 of top manifold 132 and a partition 240 positioned between front surface 238 and air handler 154 along the transverse direction T. In addition, a second air inlet 242 may be positioned at bottom surface 256 of top manifold 132 and a third air inlet 244 may be positioned at a top surface 246 of top manifold 132. Similar to first manifold inlet 230, second and third manifold inlets 242, 244 may include a plurality of slots or apertures 234. In this manner, ambient air may flow into passageway 236 through second and third inlets 242, 244. The cooling air is then drawn substantially along the lateral direction L toward side panels 136, and then into air handler 154.

According to the illustrated embodiment, top manifold includes a manifold outlet channel 250. Manifold outlet channel 250 is a self-contained air flow passageway that extends from air plenum 138 to manifold outlet 152 within top manifold 132. Air handler 154 may be positioned within manifold outlet channel 250 in top manifold 132. Air handler 154 is operable to draw gases, such as cooking fumes and/or smoke and cooling air into manifold outlet channel 250 where it may be exhausted from oven appliance 100 via manifold outlet 152.

According to the illustrated embodiment, air distribution manifold 130 further includes an air knife assembly 252 configured for providing a flow of air across opening 112 of housing 102. Air knife assembly 252 may generally include an air diverter 254 positioned within manifold outlet channel 250. Air diverter 254 is configured to divert at least a portion of the air exiting manifold outlet 154 through manifold outlet channel 250. In this regard, air diverter may be a flat, solid piece of material, e.g., sheet metal, which extends from a bottom surface 256 of top manifold 132 proximate opening 112 of housing upward along the vertical direction V to the manifold outlet channel 250. Notably, as best illustrated in FIG. 10, air diverter 254 also serves as partition 240 that defines part of passageway 236 (described above). Air diverter 254 may include a hooked end 258 that extends into manifold outlet channel 250, such that air diverter 254 scoops a portion of flowing air and directs it downward into an equalizing chamber 260. Equalizing chamber 260 serves to receive, stabilize, and reduce pressure variations within the stream of air diverted by air diverter 254 by providing a volume in which a relatively constant pressure may be maintained when air handler 154 is operating.

Air knife assembly 252 may further include an elongated air nozzle 262 that is in fluid communication with equalizing chamber 260 via apertures 264. Elongated air nozzle 262 may extend along the lateral direction L across approximately the entire width of opening 112. Pressurized air from within equalizing chamber 260 flows through apertures 264 and out of elongated air nozzle 262 at a velocity sufficient to prevent gases, fumes, and hot air from exiting opening 112. The angle and configuration of elongated air nozzle 262 may be adjusted to regulate the velocity and angle of air flow, thereby minimizing the escape of hot air or fumes from within cooking chamber 110 through opening 102.

Oven appliance 100 also includes features for assisting with regulating heating of cooking chamber 110 of housing 102 with upper and lower heating element arrays 142, 144. For example, as shown in FIGS. 4 and 5, oven appliance 100 also includes an upper temperature sensor 270. Upper temperature sensor 270 is positioned within top portion 122 of cooking chamber 110 at approximately at a midpoint of upper heating element array 142 along the transverse direction T. Similarly, oven appliance 100 includes a lower temperature sensor 272. Lower temperature sensor 272 is positioned within bottom portion 120 of cooking chamber 110 at approximately at a midpoint of lower heating element array 144 along the transverse direction T. Lower temperature sensor 272 may be positioned within baking stone 118, as shown in FIG. 4. Thus, lower temperature sensor 272 may be embedded within the material of baking stone 118, and temperature measurements from lower temperature sensor 272 may correspond to the temperature of baking stone 118. One skilled in the art will appreciate that any suitable type, number, and location of temperature sensors 270, 272 may be used and remain within the scope of the present subject matter.

Oven appliance 100 also includes a controller 274 for providing desired functionality for oven appliance 100. For instance, as will be described below, the controller 274 may be configured to control the activation and deactivation of upper and lower heating element arrays 142, 144 in order to regulate heating of cooking chamber 110 with upper and lower heating element arrays 142, 144. For instance, by controlling the operation of the upper and lower heating element arrays 142, 144, the controller 274 may be configured to control the various operating modes of the oven appliance 100, such as baking, roasting, broiling, cleaning, and/or any other suitable operations.

It should be appreciated that controller 274 may generally comprise any suitable processor-based device known in the art. Thus, in several embodiments, controller 274 may include one or more processor(s) and associated memory device(s) configured to perform a variety of computer-implemented functions. As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, the memory of controller 274 may generally comprise memory element(s) including, but are not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements. Such memory may generally be configured to store suitable computer-readable instructions that, when implemented by the processor(s), configure controller 274 to perform various computer-implemented functions, such as by implementing embodiments of the heating element array operating algorithm disclosed herein. In addition, controller 274 may also include various other suitable components, such as a communications circuit or module, one or more input/output channels, a data/control bus and/or the like.

Turning back to FIG. 1, oven appliance 100 may also include a control panel 276 on air distribution manifold 130. According to the illustrated embodiment, control panel 276 is a touch-sensitive graphical display, as is known in the art. Control panel 276 may alternatively include one or more user-interface elements (e.g., buttons, knobs, etc.) for receiving user inputs associated with controlling the operation of oven appliance 100. For instance, a user may utilize the user-interface elements to input a desired oven temperature into controller 274. Controller 274 may then control the operation of oven appliance 100 (e.g., by activating/deactivating one or more of upper heating element array 142 and lower heating element array 144) so as to adjust the internal temperature within cooking chamber 110 to the user-selected temperature and/or to maintain the internal temperature at such user-selected temperature.

Moreover, controller 274 may be communicatively coupled to upper and lower temperature sensors 270, 272, e.g., for monitoring the internal temperature within cooking chamber 110. Specifically, upper and lower temperature sensors 270, 272 may be configured to transmit temperature measurements to controller 274. Controller 274 may then control the operation of oven appliance 100 based on the temperature measurements so as to heat the oven temperature up to and/or maintain such temperature at the user-selected temperature. For example, controller 274 is in operative communication with upper heating element array 142, lower heating element array 144, upper temperature sensor 270 and lower temperature sensor 272. Controller 274 is configured for independently operating each of upper heating element array 142 and lower heating element array 144 in response to temperature measurements from upper temperature sensor 270, lower temperature sensor 272, or both.

Controller 274 may regulate the power output of upper heating element array 142 and lower heating element array 144 using any suitable method or mechanism. For example, controller 274 may utilize a triode for alternating current (TRIAC) and/or pulse-width modulation of a voltage supplied to a solid state relay to regulate the power output of each of upper heating element array 142 and lower heating element array 144.

By independently operating upper heating element array 142 and lower heating element array 144, a cooking performance of oven appliance 100 may be facilitated. In particular, such operating may provide uniform energy distribution to a food product within cooking chamber 110. For example, the opening 112 of housing 102 can provide a large thermal gradient between bottom and top portion 120, 122 of cooking chamber 110. Controller 274 may operate the zones of upper and lower heating element arrays 142, 144 to provide particular and/or unique amounts of power and energy to predefined zones in order to evenly heat the food product within cooking chamber 110.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance, comprising:

a housing defining a cooking chamber and an opening for accessing the cooking chamber;

an upper heating element array positioned within the housing at a top portion of the cooking chamber;

a baking stone positioned within the housing at a bottom portion of the cooking chamber;

a lower heating element array positioned within the housing below the baking stone adjacent the bottom portion of the cooking chamber;

an air distribution manifold mounted to a front of the housing at the opening of the housing, the air distribution manifold defining a manifold inlet and a manifold outlet, the air distribution manifold comprising a top manifold, a bottom manifold, and two side manifolds that are in fluid communication with each other and extend vertically about and define the opening of the housing; and an air handler positioned within the air distribution manifold, the air handler being configured for drawing air in the manifold inlet and urging air out the manifold outlet.

2. The oven appliance of claim 1, wherein the manifold inlet is positioned in the bottom manifold and the manifold outlet is positioned in the top manifold, such that the air handler draws ambient air into the bottom manifold, through the two side manifolds, and out of the top manifold.

3. The oven appliance of claim 2, wherein the oven appliance further comprises a venting channel positioned within a top of the cooking chamber and a rear cooling channel defined behind a rear wall of the cooking chamber, the venting channel being in fluid communication with the rear cooling channel through a rear channel outlet and with a venting channel inlet defined in the top manifold, such that the air handler draws heated air from the cooking chamber and from the rear cooling channel into the air distribution manifold through the venting channel inlet.

4. The oven appliance of claim 3, wherein the venting channel is defined at least in part by a top wall of the cooking chamber and a perforated reflector positioned within the top portion of the cooking chamber.

5. The oven appliance of claim 3, wherein the oven appliance further comprises a smoke reduction catalyst positioned within the venting channel.

6. The oven appliance of claim 1, wherein the air handler is positioned within the top manifold of the air distribution manifold.

7. The oven appliance of claim 6, wherein the air handler is a tangential fan.

8. The oven appliance of claim 1, wherein the air handler urges air out of the manifold outlet through a manifold outlet channel, the oven appliance further comprising an air diverter positioned within the manifold outlet channel, the air diverter configured to divert a portion of the air exiting the manifold outlet channel into an elongated air nozzle positioned at the top manifold of the air distribution manifold and configured to urge a curtain of air into the opening of the housing.

9. The oven appliance of claim 8, wherein a pressure equalizing manifold is positioned between the air diverter and the elongated air nozzle to receive and stabilize the diverted portion of pressurized air.

10. The oven appliance of claim 1, further comprising a cooling air duct positioned at a lateral side of the cooking chamber, the cooling air duct extending between an entrance positioned at a back side of the oven appliance and an exit positioned at a front portion of the cooking chamber, the exit of the cooling air duct being in fluid communication with one or more of the side manifolds of the air distribution manifold.

11. The oven appliance of claim 10, wherein the exit of the cooling air duct comprises a plurality of apertures opening into the two side portions of the air distribution manifold.

12. An air distribution assembly for an oven appliance, the oven appliance comprising a housing defining a cooking chamber and an opening for accessing the cooking chamber, the air distribution assembly comprising:

an air distribution manifold mounted to the housing at the opening of the housing, the air distribution manifold defining a manifold inlet, a manifold outlet, and a manifold opening that corresponds with the opening of the housing, the air distribution manifold comprising two side manifolds that extend vertically about and at least partially define the opening; and an air handler positioned within the air distribution manifold, the air handler being configured for drawing air in the manifold inlet and urging air out the manifold outlet.

13. The air distribution assembly of claim 12, wherein the manifold inlet is positioned in a bottom portion of the air distribution manifold and the manifold outlet is positioned in a top portion of the air distribution manifold, such that the air handler draws ambient air in through the bottom manifold and out of the top manifold.

14. The air distribution assembly of claim 13, wherein the oven appliance further comprises a venting channel positioned within a top of the cooking chamber and a rear cooling channel defined behind a rear wall of the cooking chamber, the venting channel being in fluid communication with the rear cooling channel through a rear channel outlet and with a venting channel inlet defined in the top portion of the air distribution manifold, such that the air handler draws heated air from the cooking chamber and from the rear cooling channel into the air distribution manifold through the venting channel inlet.

15. The air distribution assembly of claim 14, wherein the venting channel is defined at least in part by a top wall of the cooking chamber and a perforated reflector positioned within a top portion of the cooking chamber, and wherein the oven appliance further comprises a smoke reduction catalyst positioned within the venting channel.

16. The air distribution assembly of claim 13, wherein the air handler is positioned within the top portion of the air distribution manifold.

17. The air distribution assembly of claim 12, wherein the air handler urges air out of the manifold outlet through a manifold outlet channel, the oven appliance further comprising an air diverter positioned within the manifold outlet channel, the air diverter configured to divert a portion of the air exiting the manifold outlet channel into an elongated air nozzle positioned at the top portion of the air distribution manifold and configured to urge a curtain of air into the opening of the housing.

18. The air distribution assembly of claim 12, further comprising a cooling air duct positioned at a lateral side of the cooking chamber, the cooling air duct extending between an entrance positioned at a back side of the oven appliance and an exit positioned at a front portion of the cooking chamber, the exit of the cooling air duct being in fluid communication with one or more of the side manifolds of the air distribution manifold.

19. The air distribution assembly of claim 18, wherein a pressure equalizing manifold is positioned between the air diverter and the elongated air nozzle to receive and stabilize the diverted portion of pressurized air.

20. The air distribution assembly of claim 19, wherein the exit of the cooling air duct comprises a plurality of apertures opening into the air distribution manifold.

* * * * *